United States Patent [19]

Ghisoni

[11] Patent Number: 4,712,466

[45] Date of Patent: Dec. 15, 1987

[54] SEMIAUTOMATIC OPERATION REVOLVING CYLINDER PISTOL

[76] Inventor: Emilio Ghisoni, Via Villa Serafina, 4, 27100 Pavia, Italy

[21] Appl. No.: 828,916

[22] Filed: Feb. 13, 1986

[30] Foreign Application Priority Data

Feb. 13, 1985 [IT] Italy ..... 19488 A/85

[51] Int. Cl.[4] ..... F41D 7/04

[52] U.S. Cl. ..... 89/157

[58] Field of Search ..... 89/155, 156, 157

[56] References Cited

U.S. PATENT DOCUMENTS 747,073 12/1903 Huntley ..... 89/157
3,027,673 4/1962 Oliver ..... 89/157
3,055,270 9/1962 Miller ..... 89/157

FOREIGN PATENT DOCUMENTS 20275 of 1914 United Kingdom ..... 89/155

*Primary Examiner*—Stephen C. Bentley
*Attorney, Agent, or Firm*—Sughrue, Mion, Zinn, Macpeak and Seas

[57] ABSTRACT

A revolving cylinder pistol comprising a mount containing the firing mechanism and a slide carrying the barrel and cylinder. The slide is guided movably on the frame between two mechanical stops.

Each recoil stroke of the slide automatically energizes a spring motor carried in the slide itself which is effective to cause the cylinder to revolve in timed relationship with the pistol cocking. The mount supports a pusher which can energize said spring motor on request and is operated by the reload mechanism.

9 Claims, 34 Drawing Figures

FIG. 3
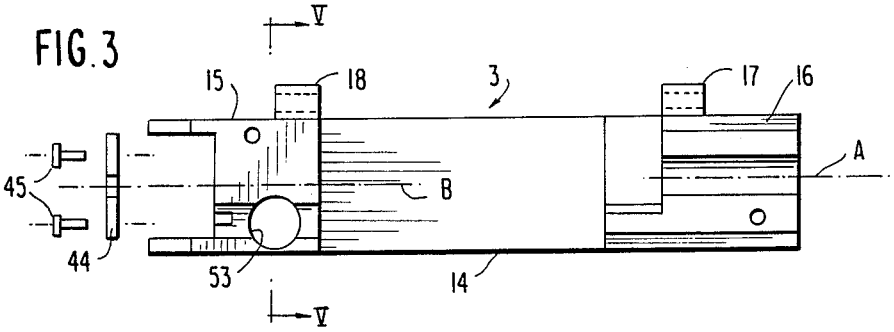
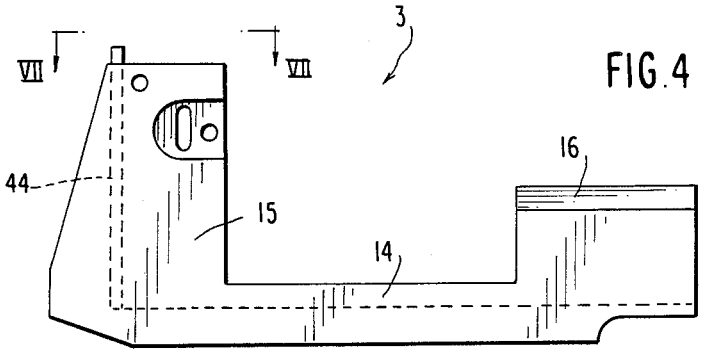
FIG. 4
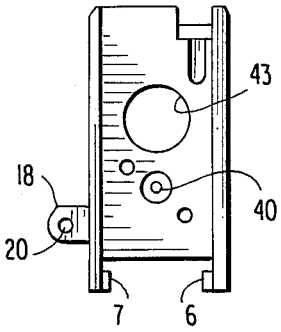
FIG. 6
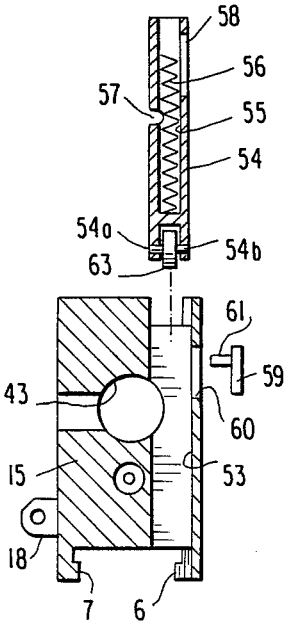
FIG. 5
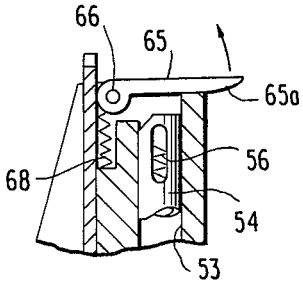
FIG. 7

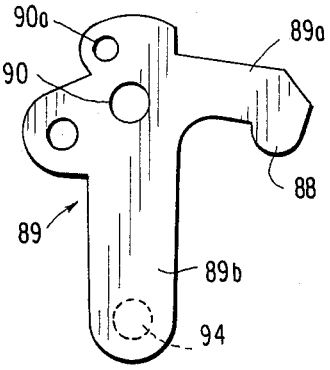
FIG.20
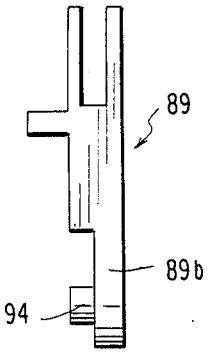
FIG.21
FIG.23
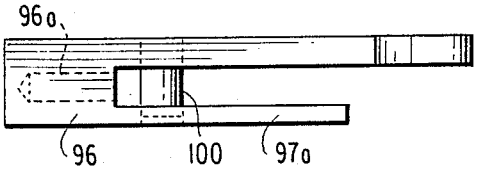
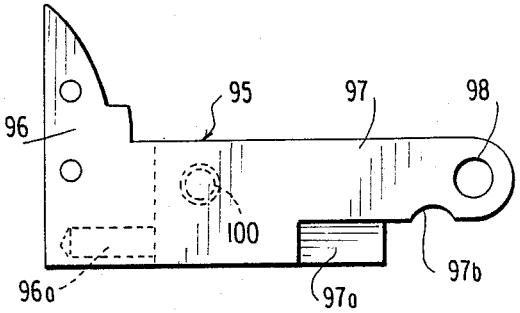
FIG.22
FIG.24
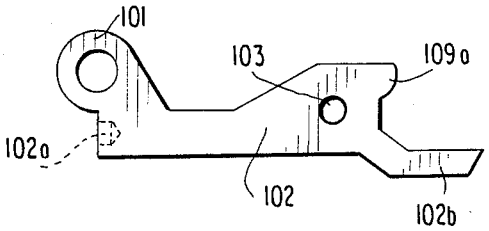
FIG.26A
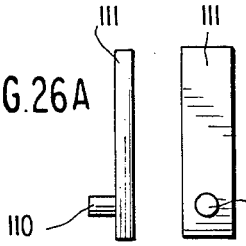
FIG.26B
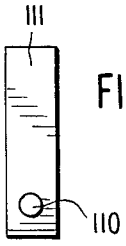
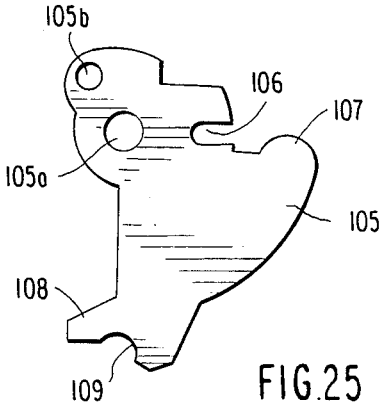
FIG.25

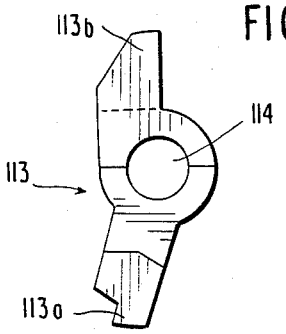
FIG. 27
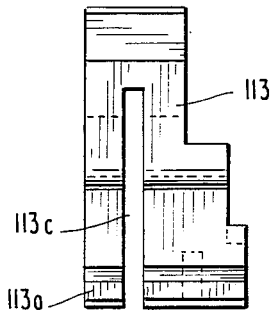
FIG. 28
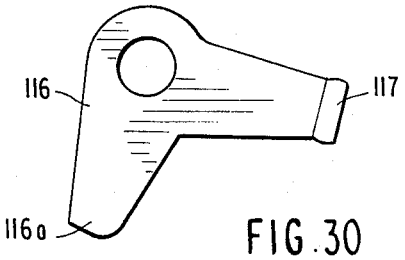
FIG. 30
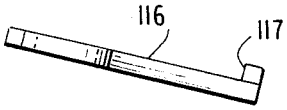
FIG. 31
FIG. 32A
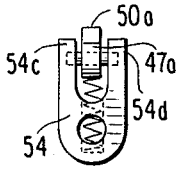
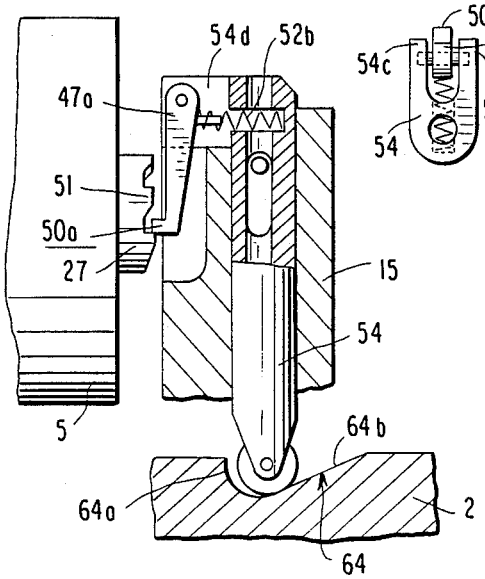
FIG. 32
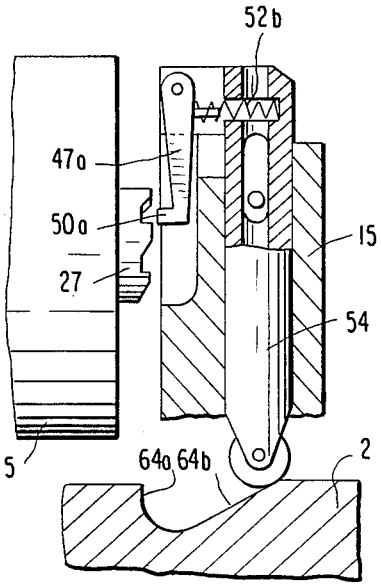
FIG. 33

SEMIAUTOMATIC OPERATION REVOLVING CYLINDER PISTOL

DESCRIPTION

This invention relates to a semiautomatic operation revolving cylinder pistol, hereinafter referred to more simply as "semiautomatic revolver".

It is a well known fact that the widespread, recognized, and still up-to-date acceptance enjoyed by revolvers is due no more to its reliable operation than to the possibility, in case of a misfire, of reloading for the next round by either pulling the gun trigger or cocking it by hand.

Also known is that some revolver types require that cocking be effected by acting on the hammerspur, and this results in the cylinder revolving to bring a cartridge chamber (or firing chamber) into alignment with the gun barrel. With other, and more widely used, types, by pulling the gun trigger, the cylinder rotation, snap cocking, striking, and firing of a round are all brought about in a continuous fashion. On releasing the trigger, the several revolver parts return to their original positions "automatically", ready for a successive operation cycle. With nearly all revolver types, however, one can reload by acting directly on the hammerspur, and in this case, the hammer is held in its ready-to-fire position by a special detent surface, on pulling the trigger, only the hammer is disengaged. This results in a higher firing accuracy because the trigger stroke length and the effort to be exerted on it are greatly reduced.

As for the revolver operation, the need has been occasionally felt for automating it; that is, the need has been felt for a semiautomatically operated revolver. To meet this demand, a revolver has been developed which utilizes the pressure from the firing gases to automatically revolve the cylinder and reload. Such a revolver, however, ran against the typical features of the gun (operation simplicity and reliability), and was soon abandoned.

Another attempt (by WEBLEY-FOSBERY) at automating revolvers centered on subdividing the revolver structure into two parts: an upper part comprising a framework supporting the barrel and cylinder, being connected slide-fashion to a lower part or frame, which contained the firing mechanism. The relative movement of the two parts, brought to be on firing, was utilized directly to re-cock and turn the cylinder. A first, basic drawback of such a semiautomatic revolver was that the cylinder rotation was only accomplished through the relative movement of the two revolver parts in the automatic mode, and could not be achieved by acting manually on the hammer or the trigger thereof. Thus, in the event of a misfire, it became necessary to manipulate the gun to pull its upper part backwards relatively to the frame by hand. Consequently, the above-mentioned primary advantage of conventional revolvers was lost.

Another drawback was that to provide for the cylinder rotation, a number of suitably profiled grooves, intersecting one another (railroad switch fashion), were provided wherein the top end of a peg attached to the gun frame was to engage slidingly. Thus, the cylinder had to be made suitably oversize in diameter, which resulted in gun carrying inconvenience. Also, since the barrel was aligned with the upper firing chamber of the cylinder, and hence, quite far from the resisting point of the gun holding hand, there occurred on firing, unless the hold on the gun was a firm one, a pivotal movement of the gun about said point instead of the desired linear movement of the upper part with respect to the lower one.

The problem that this invention is directed to solve is that of providing a revolver whose semiautomatic operation is based on utilizing the recoil brought about at the firing time, and which has such constructional features as to overcome the above-specified drawbacks of prior revolvers.

The solution idea of said technical problem is basically that of configuring the revolver upper part as a slide being guided movably on the frame and incorporating all those elements which are intended for revolving and locking the cylinder, and of linking the operation of such elements both to the gun recoil (short-distance shift of the slide along the mount) and to the firing mechanism housed within the frame, and specifically to the gun trigger and hammer.

Based on this idea, the aforesaid technical problem is solved according to the invention by a semiautomatic revolver comprising a frame containing the firing mechanism, and a slide supporting the revolver barrel and cylinder, said slide being guided movably on said frame between two mechanical stops and against the bias of spring means, characterized in that it comprises:

a rear housing formed on said slide and defining, rearwardly therein, a cylinder accommodating area;

a cylinder mounted in said area and having ratchet teeth on one end thereof a pawl and ratchet device carried in said frame and being arranged to act, a spring motor in said housing for actuating said pawl and ratchet device;

a means for energizing said spring motor, being actuated automatically by the recoil stroke of said slide on the frame each time that a round is fired; and a pusher, guided movably in said frame and being linked mechanically to said firing mechanism and acting on said spring motor to energize it.

Advantageously, and in accordance with a preferred embodiment of this invention, said semiautomatic revolver is characterized in that it comprises:

a rear housing formed on said slide and defining rearwardly an area for accommodating said cylinder;

a cylinder mounted in said area and having ratchet teeth on one end thereof a cylindrical seat formed in said housing coaxially with said cylinder, as mounted in said cylinder accommodating area, said cylindrical seat being open toward the cylinder;

a sprocket fitting rotatably and slidingly within said cylindrical seat;

at least one tooth formed on the wall of said sprocket confronting said cylinder, said at least one tooth being engaged operatively, with said teeth formed on said cylinder;

a slider-rack being guided movably in said housing and in constant engagement with said sprocket and subjected to the action of a spring;

a means for loading said spring automatically, being actuated by the slide recoil stroke; and a pusher guided movably in said frame, and being linked mechanically to the firing mechanism and active on said slider and said spring.

Further features and advantages of the invention will become more clearly apparent from the detailed description of an exemplary embodiment of a semiautomatic revolver according thereto, given herein below with reference to the accompanying illustrative and non-limitative drawings, where:

FIG. 3 is a diagramatic, reduced scale, top view of the slide of the semiautomatic revolver of FIG. 1;

FIG. 4 is a reduced scale side view showing diagramatically the slide of FIG. 3;

FIG. 5 is a sectional view taken along the line V—V in FIG. 3, with some details shown exploded;

FIG. 6 is a rear view of the slide of FIG. 4;

FIG. 7 is a part-sectional view taken along the line VII—VII in FIG. 4;

FIGS. 20 to 28 and 30,31 show schematically a plurality of mechanical details of the release mechanisms contained within the frame of the inventive revolver;

FIGS. 32 and 33 show diagramatically a modified embodiment of the sprocket device of FIGS. 8–10.

FIG. 32 is a top view of the slider 54 as shown in FIG. 32.

Figure 1:
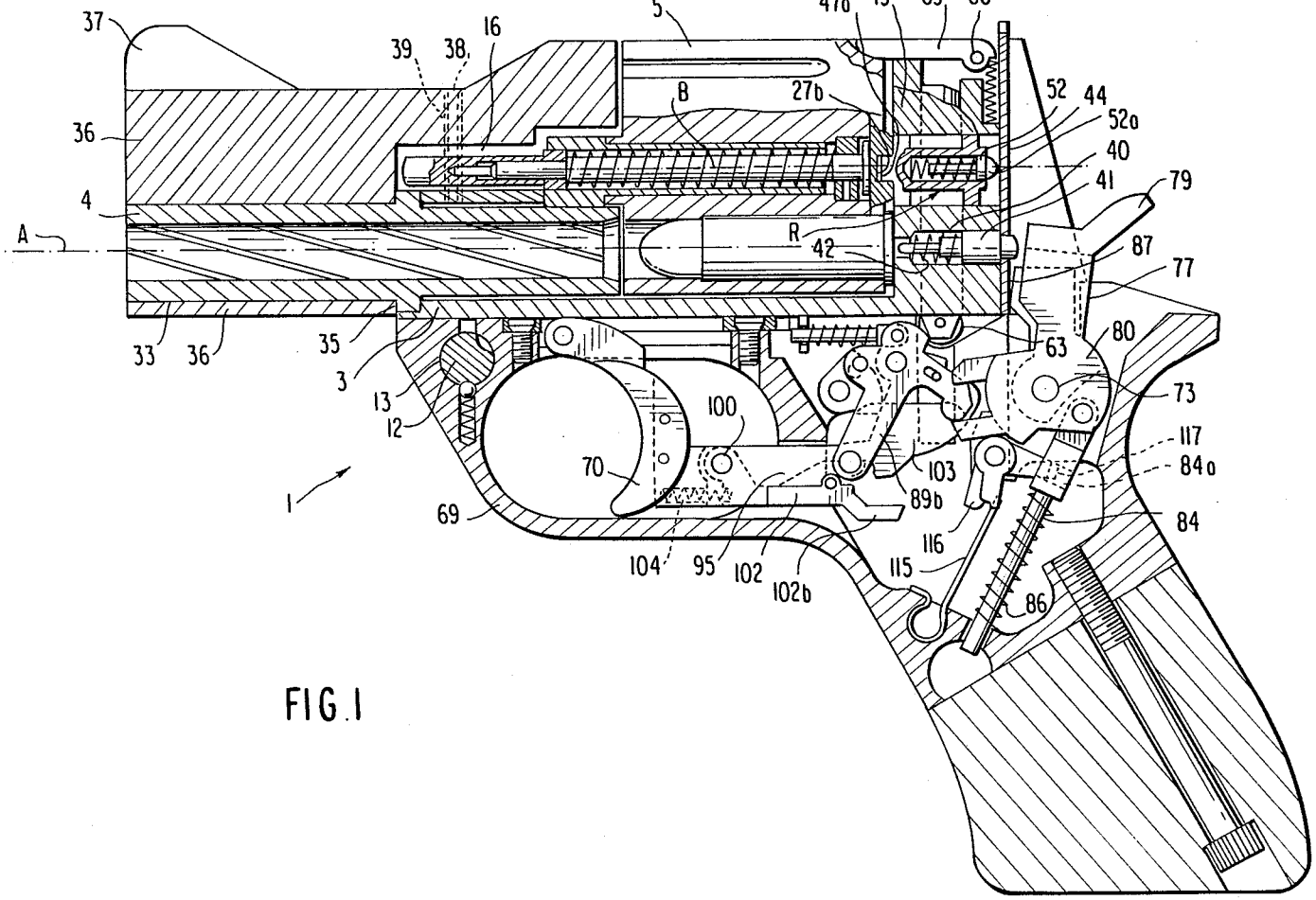
FIG. 1 shows in longitudinal axial section a semiautomatic revolver according to the invention.

With reference to the aforesaid drawing figures, generally indicated at 1 is a semiautomatic revolver according to this invention. Said revolver comprises a frame 2, containing all the firing mechanisms to be described hereinafter, and a slide 3 carrying the gun barrel 4 and a revolving cylinder 5 of the revolver.

The slide 3 is mounted removably on the frame 2, whereon it is guided slidingly in the longitudinal direction. To that aim, the slide 3 is provided with a pair of undercut guides 6,7 movingly engaged with runways formed longitudinally in the sides of the frame 2. The linear movements of the slide 3 are of limited magnitude and restricted, at one end, by a pair of identical elevations 10,11, only one of which is indicated, formed on the frame 2, and at the other end, by a mechanical stop 12 engaged mechanically in a hole 13, also formed in the frame 2, wherein it is lockable in a position interfering with the travel path of the slide 3. This mechanical stop is essentially of a known type in the pertinent art (Walter P38).

For a clearer understanding of the structural features of the semiautomatic revolver according to this invention, the slide 3 and frame 2 thereof will be discussed hereinafter separately. Throughout the specification and the appended claims, the terms forward and rearward refer to the gun as held in the hand, and the terms right and left are related to the axis of the barrel 4 and/or the cylinder 5 and/or the longitudinal axis of the housing 2.

THE SLIDE

Figure 2:
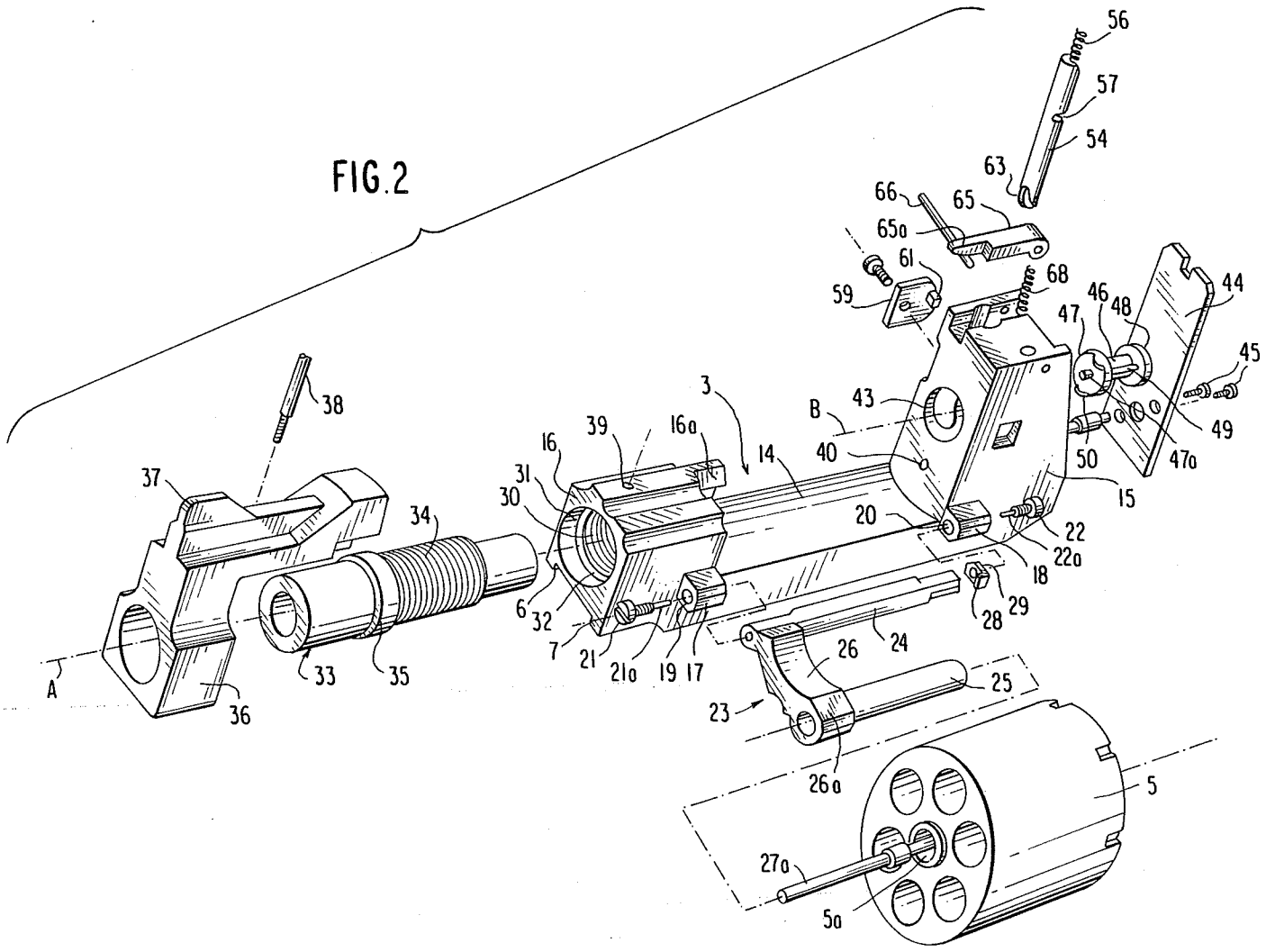
FIG. 2 shows in perspective an exploded view of the slide for the semiautomatic revolver of FIG. 1.

This comprises essentially a one-piece construction slide 14 (FIG. 2) formed with a rearward housing 15 and a forward housing 16 set apart by a distance equal to the length of the cylinder 5.

The cylinder 5 is mounted removably on the slide 14 by journalling lengthwise on two small blocks 17, 18 formed, or otherwise secured, on the left-hand flank of the slide 14. In particular, said small blocks 17, 18 are through-penetrated by respective threaded holes 19,20 having a common axis that lies lengthwise to said slide 14. Threaded into the holes 19 and 20 are two screws 21,22 which have end portions 21a and 22a left plain and projecting beyond the blocks 17 and 18 to form respective juxtaposed trunnions for a substantially fork-like tilting element 23. This tilting element 23 comprises a first arm 24 having oppositely located ends which are journalled on the above-mentioned portions 21*a* and 22*a*, and a second arm 25 attached cantilever-fashion to one end of a plate 26, the other end of which is attached to the arm 24. The arm 25 extends unrestrictedly toward the rear housing 15 and is sized to engage slidingly and pivotally in the bore 5*a* which extends axially through the cylinder 5. The arm 25 is also drilled axially to freely admit an ejector rod 27*a* the rear end of which has a substantially disk-like extractor 27.

Through the tilting element 23, the cylinder 6 can be shifted from a first position whereat it fits in between the rear housing 15 and the forward housing 16 of the slide 14, to a second position whereat it lies completely outside said slide.

The first position is defined by a positive stop formed between a flat shoulder 16*a*, formed in the forward housing 16 and jutting out of it toward the rear housing 15, and a flat wall 26*a* formed on the plate 26 of the tilting element 23.

The forward housing 16 is through-penetrated by a threaded hole 30, being preceded by a plain lead-in section 31 which has a larger inside diameter than said hole 30. Formed between this section 31 and the threaded hole 30 is an annular shoulder 32.

Indicated at 33 is a gun barrel having a threaded portion 34 intended to be threaded into the threaded hole 30, and an annular rim 35 intended to abut against the annular shoulder 32. A sleeve 36, carrying the sight 37, is fitted on the forward section of the barrel 33 to jut out of the housing 16, and is fastened to the housing 16 by means of a suitable screw 38, threaded into a threaded hole 39.

With reference to FIG. 1, it should be noted that the axis A of the barrel 33, as mounted on the slide 3, coincides with the axis of the lowermost cartridge chamber of the cylinder 5, as held in the first position specified above (firing position).

This same axis A coincides with the axis of a bore 40, formed in the rear housing 15 and being the seat for a firing pin 41 and its respective return spring 42.

Indicated at B is the axis of the cylinder 5 as held in its firing position. This same axis B coincides with the axis of a cylindrical bore 43 which extends through the rear housing 15 and is closed rearwardly by an abutment plate 44 being fastened removably to the frame itself, by means of screws 45, at a recessed location relatively to to the lateral sides thereof.

Mounted slidingly and rotatably in said cylindrical bore 43 is a sprocket R including a hub 46, forward disk 47, and a rear disk 48. At a location between said disks 47,48, eccentrically from the hub 46, there is secured a parallel peg 49 to the sprocket axis.

The forward disk 47 is provided with a pair of face teeth 50 intended for engagement with the teeth 51 of an annular arrangement formed on the face of the disk-like extractor 27.

Figure 8:
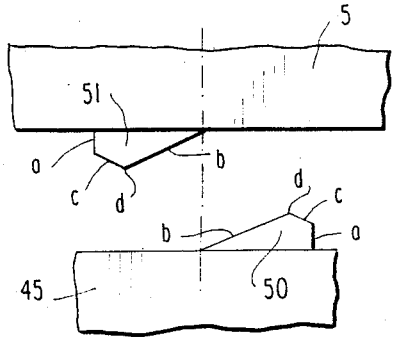

The teeth 51, provided in an equal number to the number of the cartridge chambers in the cylinder 5, and the teeth 50 of the sprocket (46–48) have identical but opposed profiles. Specifically with reference to FIG. 8, each of said teeth 50 and 51 has a face a perpendicular to the disk 47 and the disk-like extractor, extending radially thereto, a slanted back b, and in between, a bevel c which defines, with said back b, a ridge d.

The forward disk 47 of the sprocket R is also provided axially with a hub 47*a* (FIG. 1) adapted to engage slidingly and rotatably in a cylindrical recess 27*b* formed axially in the spider extractor 27.

A spring 52 on a spring guide 52*a* constantly biases the sprocket R (46–48) toward the spider extractor 27.

Figure 9:
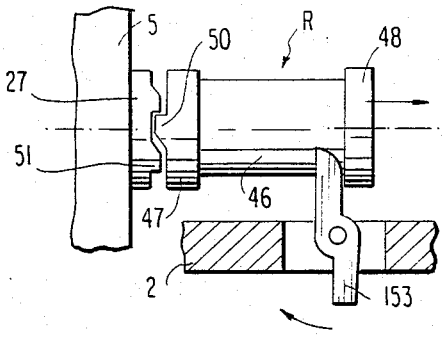
FIGS. 8 to 10 show schematically, and to an enlarged scale, details of a sprocket device mounted on the slide of FIG. 1 to drive the cylinder of the semiautomatic revolver of this invention.
Figure 10:
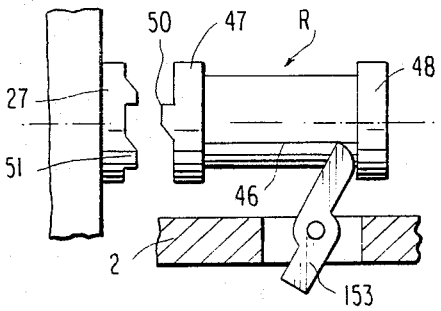

A key 153 (FIGS. 9 and 10), which is accessible and manually actuatable from the exterior of the rear housing 15, is active on the disk 48 of the sprocket (46–48) to drive it back into the bore 43 against the bias of the spring 52 and release the cylinder 5 (FIGS. 9–10).

In the rear housing 15, at an eccentric position toward the right-hand lateral side thereof, there is formed a throughgoing cylindrical bore 53, being perpendicular to and intersecting the bore 43 accommodating the sprocket 46–48. Mounted slidingly within the through bore 53 is a cylindrical slider 54, formed axially with a blind hole 55 wherein there fits a spring 56.

In the wall of the slider 54, on the side thereof facing the bore 43, there is formed a notch 57 adapted to engage with the peg 49 on the sprocket 46–48. At a diametrically opposed location, the slider 54 is formed with a slot 58 which extends along a generatrix line thereof and has a set length dimension.

A small plate 59, attached removably to a lateral side of the rear housing 15, preferably in a suitably sized seat 60, is provided with a detent 61 extending through the slot 58 toward the interior of the slider 54 to form a fixed bearing for the top end of the spring 56. It may be appreciated that the travel distance of the slider 54 in its respective bore 53 is determined by the length of the slot 58.

Figure 11:
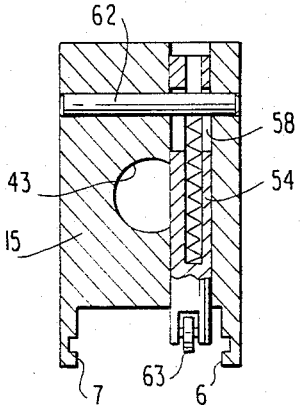
FIG. 11 is a sectional view of a modified embodiment of the slide shown in FIG. 5.

Of course, said detent for the spring 56 may be comprised of an equivalent means, such as (FIG. 11) a peg 62 carried on the rear housing 15 and extending bridge-like across the slider 54, at a suitable distance from the bottom of the hole 55 thereof.

The slider 54 is provided at the bottom with a wheel 63 supported rotatably in between a pair of lugs 54*a*,54*b* formed on the slider itself. The wheel 63 is in rolling engagement with a track 64 formed on the top profile of the right-hand lateral side of the frame 2.

The track 64 (FIGS. 12 to 15) comprises a forward section 64*a*, extending substantially in an arc of a circle and being adapted to receive the wheel 63 of the slider 54, and an inclined rear section 64*b* which climbs up toward the rear of the frame 2. In practice, the track 64 forms a feeler for said profile. It should be noted that, with the wheel 63 on the forward section 64*a* of the track 64, the lug 54*a* of the slider will protrude inwardly of the frame 2.

Indicated at 65 is a rod-like index having one end mounted on a pin 66, carried on the rear housing 15, and the other end 65*a*, protruding forwardly from said frame, engaged removably in a notch 67 of plural notches formed peripherally in the cylinder 5. A bias spring 68 urges the index 65 constantly into a position of engagement in one notch 67. It should be noted that said index 65 extneds across the bore 53 so as to interfere with the travel path of the slider 54.

THE FRAME

The frame 2 comprises a flattened box-type body whose undercut runways for the sliding movement of the slide 3 have already been described, the stops 10,11 and 12 which delimit the movements of said slide on the frame 2, and the cam-like profiled track 64.

Figure 18:
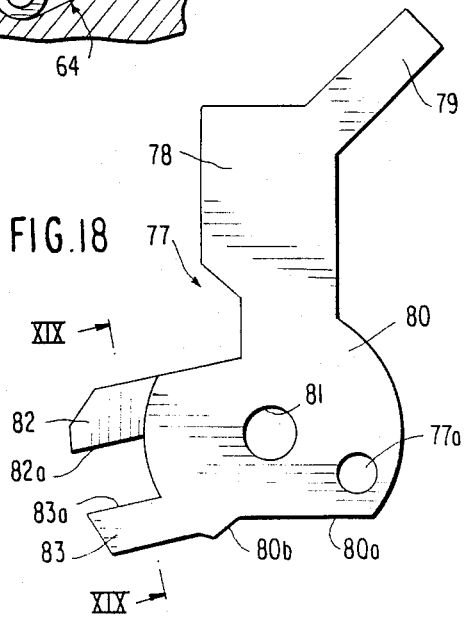
FIG. 18 is a side view of the hammer of the semiautomatic revolver of this invention.
Figure 19:
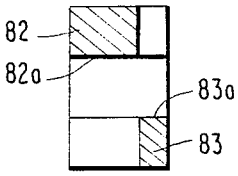
FIG. 19 is a sectional view taken along the line XIX—XIX of FIG. 18.

On the frame 2, a guard 69 defines a forward area accommodating a trigger 70, which area is in communication, through a passageway 71, with a box 72 housing the first mechanism. Within this box 72, on one side of the frame 2, there are secured the pins 73, 74,75 and 76. Journalled on the pin 73 is the hammer 77, of which there are clearly shown in FIGS. 17 to 19 the part 78 acting on the firing pin 41, the hammer spur 79, and a base part 80 of substantially disk-like shape and being through-penetrated by a hole 81 for mounting said hammer to the pin 73.

The hammer 17 is provided forwardly with two parallel lugs 82,83 set apart along the circular profile of the base part 80 of said hammer in mutually offset relationship.

To the hammer 77, rearwardly of the pin 73, there is journalled at 77*a* the top end of a rod-like spring guide 84, the other end of which is guided, slidingly in a bore 85 formed at the bottom of the firing mechanism box 72. A spring 86, fitted over said spring guide 84, is arranged to act on the hammer 77 to oppose its angular movement into the cocked position.

Engaged with the active part 83*a* of the arm 83 of said hammer 77 is a half-round lug 88, formed on the end of an arm 89*a* of a plate-like lever 89, of substantially cranked shape (FIG. 20). This lever 89 is through-penetrated centrally by a hole 90, by means of which it is journalled on the fixed pin 75. Journalled to the plate-like level 89, near the hole 90*a*, is the head of a spring guide 91 engaged slidingly through a passageway formed in a supporting detent 92. A spring 93 on said spring guide 91 resists the angular movements of the lever 89 in a counterclockwise direction with reference to the cited Figures.

Attached to the otherarm 89*b* of said level 89 is a pin 94.

Indicated at 95 in FIGS. 22,23 is a two-rod link comprising a base portion 96, a first arm 97 and a second arm 97*a*, parallel to and shorter than the first. Via split pins or the like conventional locking means not shown, the base portion 96 is secured to the trigger 70, whence the link 95 extends fully out, through the passageway 71 toward the box 72 for the firing mechanism.

In the end of said link 95 arm 97, there is formed a hole 98, wherein the pin 94 of the lever 89 is journalled.

In between the arms 97 and 98 of the link 95, close to the base portion 96, there is affixed a pin 100, which has the open eye end 101 of a flat lever 102 extending between said arms mounted rotatably thereon. Secured to this lever 102 is a cylindrical peg 103 adapted to engage, in the manner explained hereinafter, in a semicircular notch 97*b* formed in the bottom side of the arm 97 of the link 95. A spring 104, fitted partway into a seat 96*a* in the base portion 96 of the link 95, and partway into a seat 102*a* in the lever 102, urges the latter to move angularly in a countercockwise direction, with reference to the cited Figures, about the axis of the pin 100.

The plate-like lever 89, link 95, and lever 102 form a drive interconnecting the hammer 77 and trigger 70.

Indicated at 105 is a further plate-like lever (FIGS. 25,17*b*) provided with a through hole 105*a* whereby it is mounted pivotally on the fixed pin 75. This lever 105 is also subjected to the bias of a spring 93*a* (FIG. 17), the spring guide 91*a* wherefor is journalled in the hole 105*b*, said spring urging the lever 105 to move angularly about the axis of said pin 75 in a clockwise direction.

Close to the pivotal connection hole 105*a*, the lever 105 has a slot 106 of elongate shape which opens rearwards of the frame 2 toward a semicircular lug 107 formed on the lever itself. On the remote end portion to that having the hole 105, there formed a foot 108 extending forwardly and a semicircular notch 109, intended for engagement with a semicircular lug 109*a* formed on the free end of the previously mentioned flat lever 102. The function served by that engagement will be more clearly apparent hereinafter.

The open slot 106 has a peg 110 engaged slidingly and pivotally therein which is secured to and contilevers from a indexing slide 111 guided movingly on the lateral side of the frame 2 provided with the camming track 64. More specifically, in said lateral side there is milled a rectangular groove 112 which is open to the semicircular start portion 64*a* of said track 64.

It should be also noted that on the pin 73 there is journalled a dummy hammer 87 which, being subjected to the bias of a spring similarly to that described in connection with the hammer 77, pushes constantly on the slide 3, resisting its movements toward the rear of the frame 2. Of course, said dummy hammer 87 would never interfere with the firing pin 41.

The trigger 70 (FIG. 17) is provided above with a ridge-like projection 70*a* and adjacent the free end of this ridge, a pin 70*b* is secured transversely with the opposed ends of the pin engaged slidingly in a T-shaped guide 70*c* formed at the top of the frame 2. It should be observed that this feature of the trigger 70 being mounted for translatory pivotal movement affords a markedly reduced construction of the top portion of the frame 2 over conventional designs. This, in combination with the slide 3 being greatly extended longitudinally (it is nearly as long as the frame 2 whereon it slides), and with the barrel being aligned to the bottom cartridge chamber of the cylinder 5, obviates the disadvantage of the gun pivoting about the resisting point on the hand gripping it upon firing a round.

OPERATION

On firing a round, the slide 3 is set into motion by the recoiling effect along the frame 2 toward the rear of the latter, which movement is opposed by the springs which act on the hammer 77 and dummy hammer 87. The wheel 63 of the slider 54 is forced along the uphill section 64*b* of the track 64. Consequently, said slider 54 will be raised against the spring 56 in its respective bore 53, producing a counterclockwise rotation of the sprocket R (46–48). On the occurrence of this rotation, the backs b of the teeth 50 and 51, respectively of the sprocket 45 and the spider extractor 27, will slide over each other causing said sprocket to move rearwardly in its axial seat 43. On moving over and past the ridges d,the teeth 50 and 51, after sliding with their respective bevels c, become aligned so as to have their faces a in a "flush" configuration (FIG. 9). Owing to the bias force of the spring 52, the sprocket R (46–48) will be returned to its forward position, thus reengaging its teeth 50 with the teeth 51 of the spider extractor 27. On raising the slider 54, the index 65 has been moved up out of engagement with the cylinder 5. Accordingly, the cylinder 5 will be let free to rotate. As the recoil effect ceases on the slide 3, predominant on it becomes the action of the spring biasing the dummy hammer 87, with the hammer 77 being held back in position. The slide is moved forward and the wheel 63 of the slider 54 caused to travel back down the sloping section 64b of the track 64 to its original position at the semicircular section 64a. As a result, the slider 54, under the urge from the spring 56, is lowered back into its respective bore 53, to produce a clockwise rotation of the sprocket (46–48). The sprocket R entrains the cylinder 5 rotatively, which results in a fresh cartridge chamber becoming aligned to to the gun barrel.

The semiautomatic revolver of this invention is thus ready for another round of fire. It should be noted that the rotation of the cylinder 5 is effected, in essence, by a spring "motor" (the slider 54 plus the sprocket R), wherein the spring is loaded by the recoil energy. Said motor, being mounted on the slide 3, comprises essentially a rack (slider 54) and pinion (sprocket R) mechanism of a basic type, wherein the face engagement between the sprocket R and cylinder 5 is of the ratchet variety.

It shall now be shown how, in the event of a misfire, the revolver of this invention still affords switching to the next round, by re-cocking with a direct action on the hammer itself or on the trigger, and simultaneous rotation of the cylinder to bring another cartridge chamber into alignment with the revolver barrel.

Figure 17:
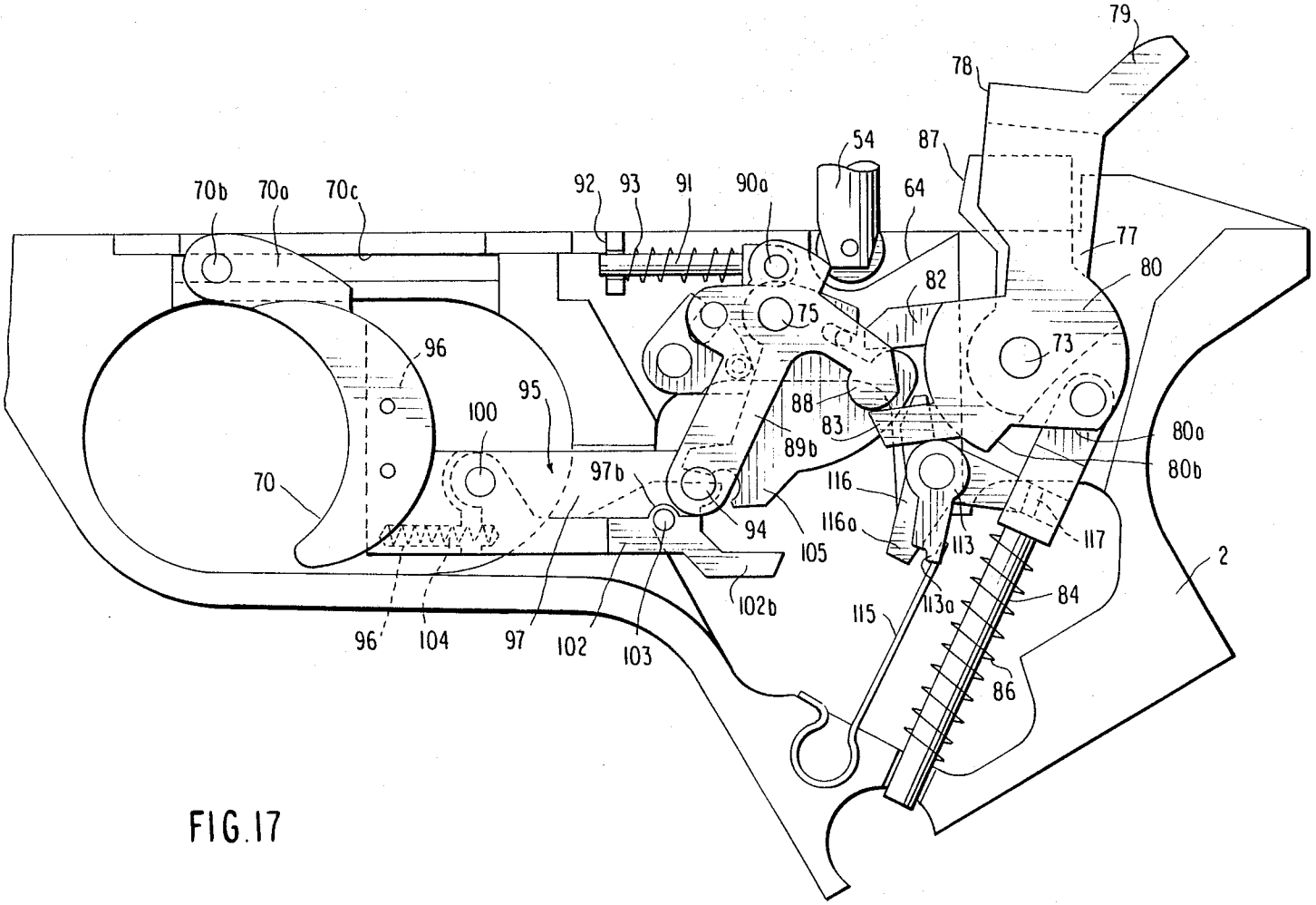
FIGS. 17 and 17B show, in longitudinal axial section, the same frame as in FIG. 16, containing the firing mechanism of the semiautomatic revolver of this invention.
Figure 17B:
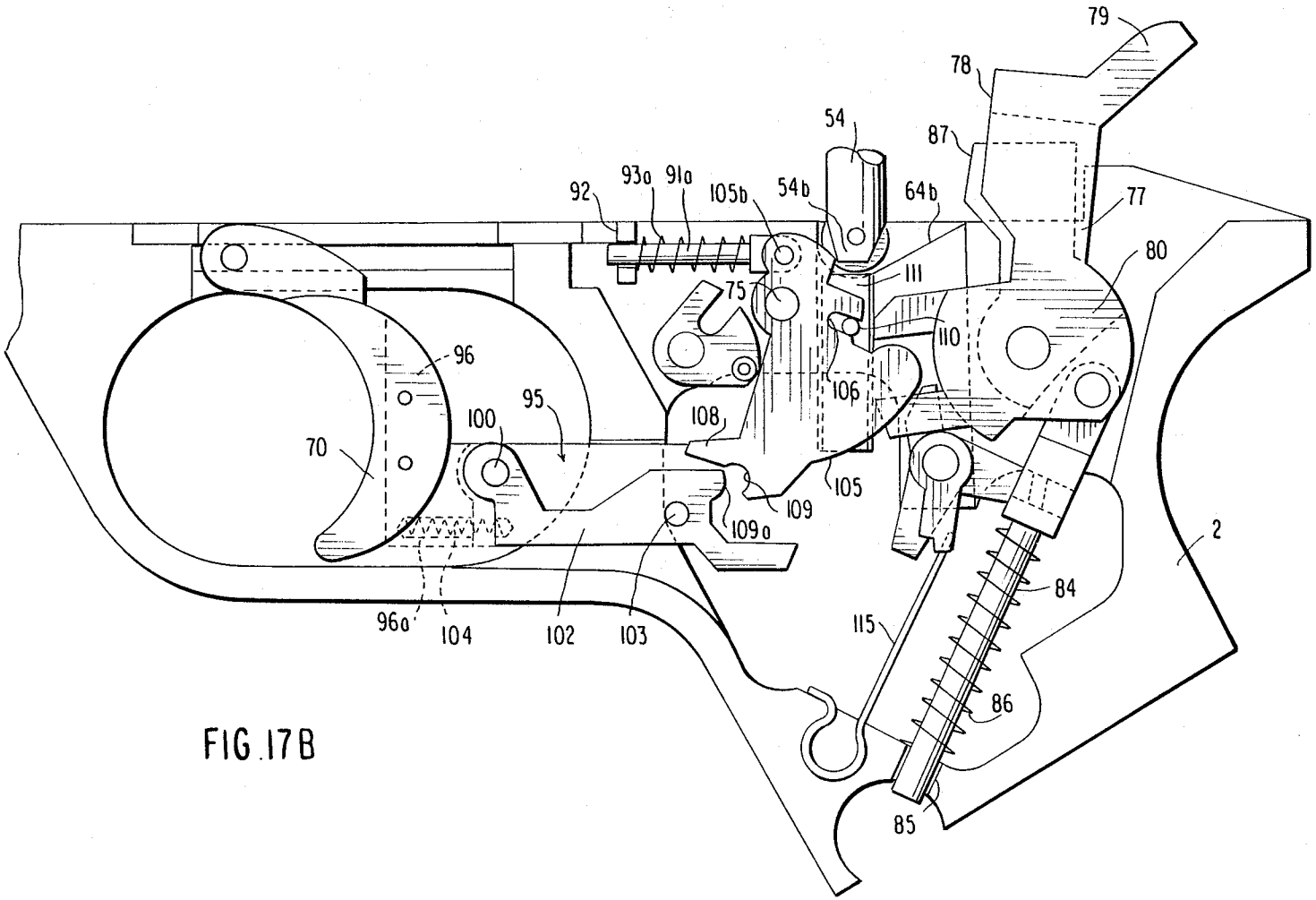
Figure 29:
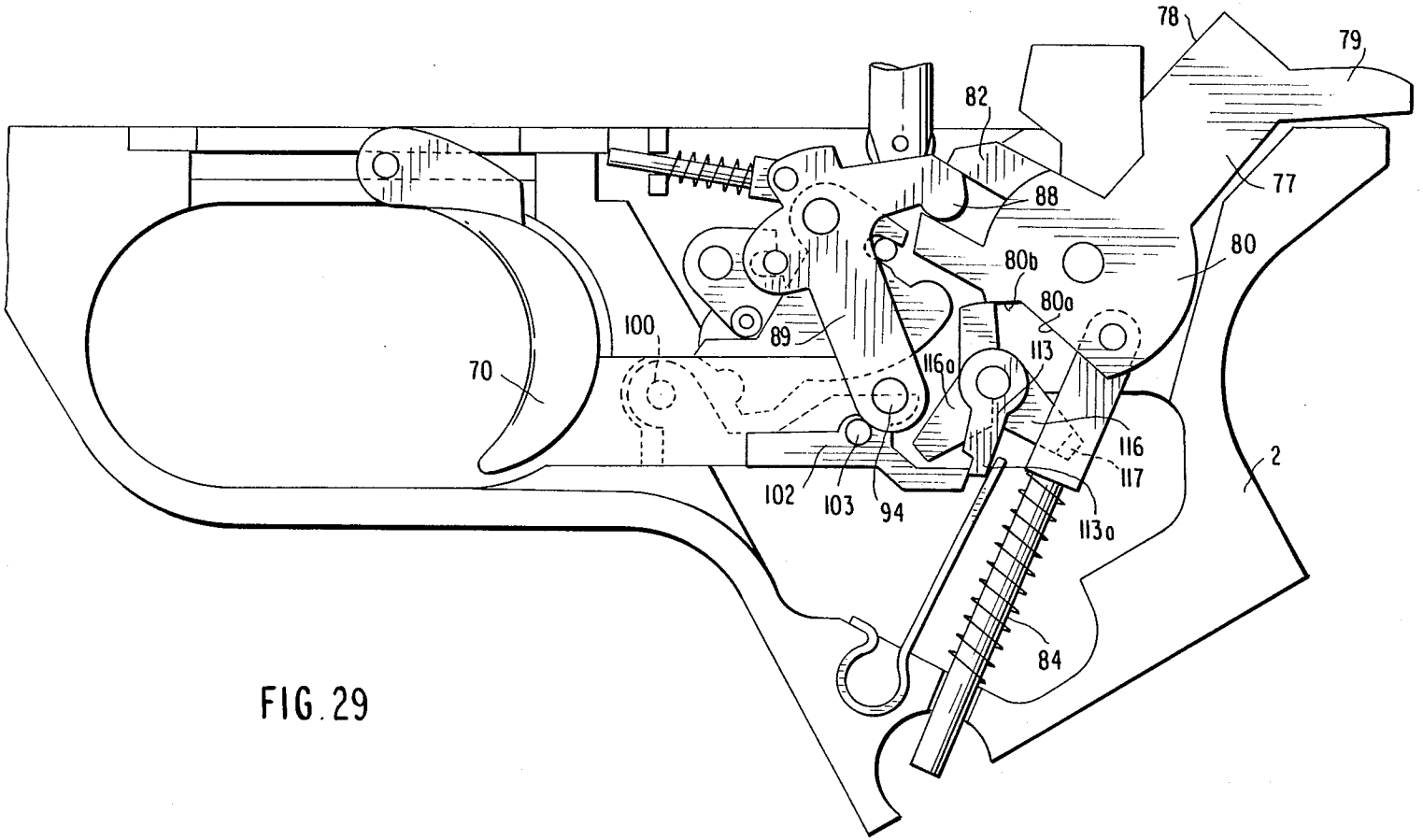
FIG. 29 shows diagramatically the same mechanisms during an operational step of the revolver according to the invention.

By acting on the hammerspur 79 of the hammer 77, an angular movement thereof is produced, about its respective pivot 73 in the clockwise direction as viewed in the drawings, simultaneously with an angular movement of the crank level 89 in the counterclockwisse direction, owing to the lug 88 thereof engaging with the arm 83 of said hammer 77. The platelike lever 89, in its angular movement about the axis of the fixed pin 75, drives the double rod link 95 rearwards owing to the pin 94 of said lever 89 becoming engaged in the hole 98, in the arm 97 of said link (FIGS. 1 and 17).

The link 95 movement is followed, of course, by a corresponding movement of the trigger 70, wherewith said link is made fast. The lever 102 also follows this rearward movement, retaining its original position by virtue of the action of the spring 104 and of the cylindrical peg 103 being engaged in the semicircular notch 97*b* of the arm 97 of the link 95.

On the flat lever 102 being so moved, the semicircular lug 109*a* (FIG. 17B) formed thereon will engage with the semicircular notch 109 in the platelike lever 105, shifting it angularly in the counter-clockwise direction as viewed in the drawings, about the axis of the fixed pin 75. As a result of this angular movement and of the slot 106 being coupled to the peg 110 of the indexing slide 111, the latter will be raised in its respective guide 112. In its upward movement, the indexing slide 111 first meets the lug 54*b* on the slider 54 from beneath, to then cause it to be raised and the sprocket R (46–48) turned counterclockwise.

As the angular movement of the plate-like lever 105 continues in the counterclockwise direction, the foot 108 thereof contacts the top side of the flat lever 102, pushing it down against the bias of the spring 104. Thus, the lever 102 is disconnected from the plate-like lever 103, i.e. the lug 109*a* is disengaged from the notch 109.

Dominant on this lever 105 becomes then the action of the spring 56 of the slider 54, which brings about an angular movement in the clockwise direction, again as viewed in the drawings. As a result, the indexing slide 111 is returned to its original position, and the slider 54, being so urged by its respective spring 56 expanding back to yield the energy stored up during the recoil step, will also be restored to its home position, with the wheel 63 engaging with the start section 64*a* of the track 64.

During this movement of the slider 54, the sprocket (46–48) is rotated in the clockwise direction and will entrain the cylinder 5 therealong, as discussed in connection with the semiautomatic operation of the revolver.

Disconnection of the lever 102 from the lever 105 occurs on the hammer 77 reaching, in its angular movement, the "cocked" position.

Figure 16:
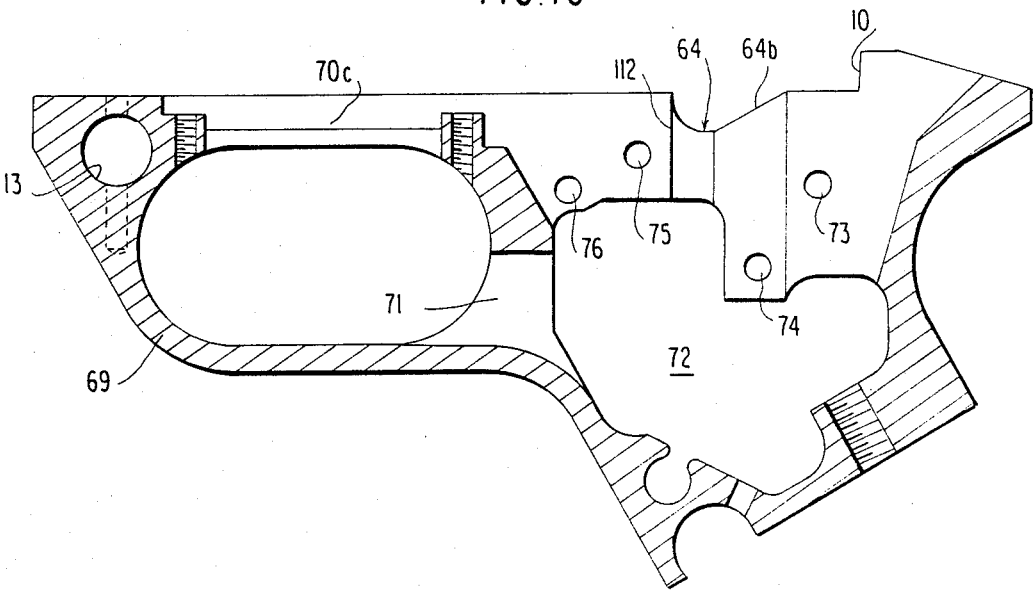
FIG. 16 shows a longitudinal axial section through the frame of the inventive semiautomatic revolver.
Figure 12:
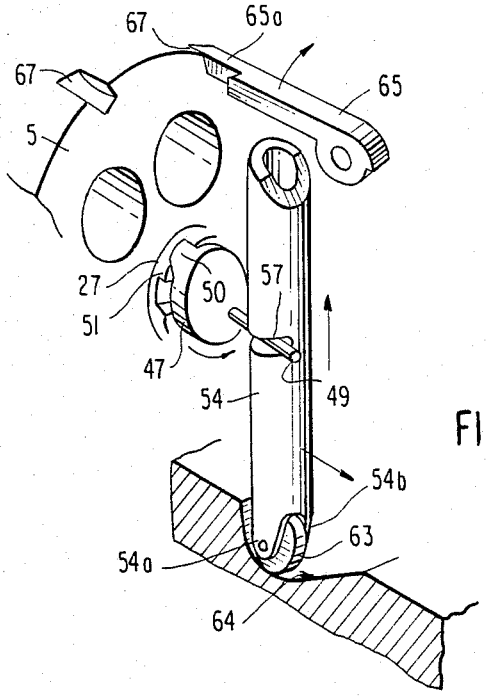
FIGS. 12 to 15 show, in perspective and diagramatically, some operation steps of the device of FIGS. 8 to 10.
Figure 14:
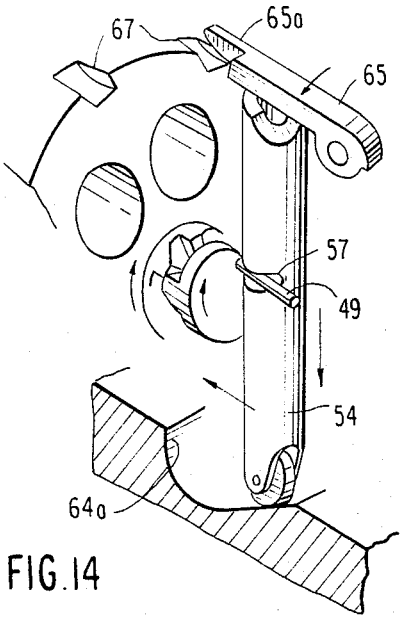
Figure 13:
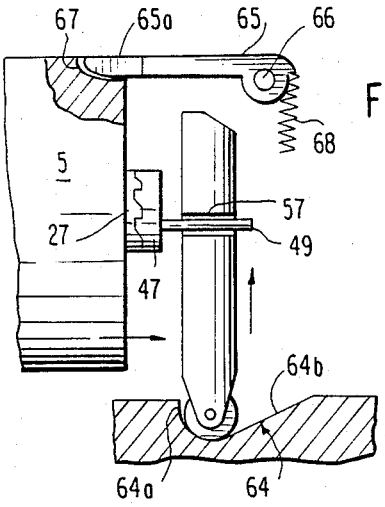
Figure 15:
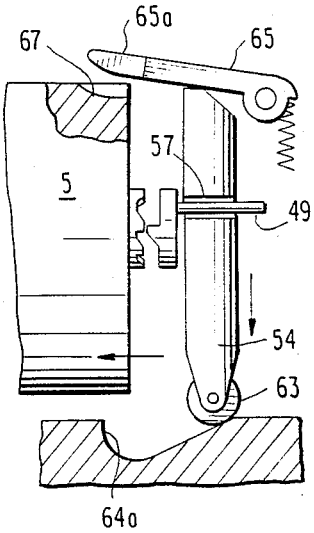

Prior to the occurrence of that disconnection, a keeper 113 (FIGS. 27,28) is brought into operation. This keeper is formed with a central hole 114 whereby it is journalled to the fixed pin 74 (FIGS. 1,16, 17). On a dog-like end 113*a* of said keeper 113 there acts a hairpin spring 115 which tends to urge it to turn in the clockwise direction as viewed in the drawings. The other end 113*b* is normally held against the forward circular profile of the base portion 80 of the hammer 77 (FIG. 1), between the arms 82 and 83 thereof.

In approaching the end of the cocking travel range of the hammer 77, due to support from the circular profile of the base portion 80 thereof being removed, the aforesaid end 113*b* of the keeper 113 will be urged by the hairpin spring 115 against the side 80*a* of the hammer 77. The rear lug 102*b* of the lever 102 is held in the down position relatively to the dog 113*a* by the action exereted thereon by the foot 108 of the lever 105.

On disconnection, the lever 105 is turned clockwise, and the foot 108 thereof is moved forward out of contact with the lever 102. This lever is then let free to resume its raised position (starting position) under the action of the spring 104. With that upward movement, the lug 102*b* of the lever 102 is brought to bear on the dog 113*b* of the keeper 113 from below.

On releasing the hammer 77, it will move forward again by a few degrees until the side 80*b* of its base portion 80 comes to rest on the end 113*b* of the keeper 113. However, the aforesaid forward angular movement of the hammer 77 will bring about a corresponding short forward movement of the entire drive interconnecting said hammer 77 and trigger 70. As a consequence, the lug 102*b* of the lever 102 moves in front of the dog 113*a* of the keeper 113 (FIG. 27).

On pulling the trigger 70, the keeper 113 will rotate counterclockwise under the urge from the lever 102, against the bias of the hairpin spring 115, thus moving out of the way of the hammer 77. Accordingly, the hammer 77 will be free to fall onto the firing pin 40.

A crank lever 116 (FIGS. 30 and 31) is journalled to the fixed pin 74, whereon the keeper 113 is mounted pivotally, and turns in a slot 113*c* formed centrally in the keeper itself (FIG. 28). This lever 116 is provided with a right-angle projecting lug 117 which engages in a cutout 84*a* formed in the head of the spring guide 84 of the hammer 77.

On the hammer 77 falling onto the firing pin 40, the lever 116 will rotate in the counterclockwise direction under the urge from the spring guide 84. The end 116*a* of the lever 116 is brought to contact and pushes on the lug 102*b* of the lever 102, and by overcoming the bias force of the spring 104, will disengage this lever 102 from its rest on the dog 113*a*.

After firing of a round, the hammer 77 moves rearwards under the thrust from the slide 3, and the spring guide 84 will resume the position it occupied prior to firing. Consequently, the lever 116 will be driven rotatively by said spring guide in the clockwise direction and its end 116*a* removed from the working area of the lever 102. As a result, the lug 102*b* of said lever 102 can arrange itself to push on the dog 113*a* for firing the next round.

In the modified embodiment of FIGS. 32,33, the rotary drive for the cylinder 5 is implemented by a pawl lever 47*b* being journalled between two parallel ears 54*c*,54*d* formed at the top of the slider 54. A spring 52*b* biases said lever 47*a* toward the cylinder 5, thereby its foot 50*a* will engage ratchet-fashion with the teeth 51 on said cylinder.

I claim:

1. A semiautomatic operation revolving cylinder pistol, comprising a frame containing a firing mechanism and a slide supporting the revolver barrel and cylinder, said slide being guided moveably on said frame between two mechanical stops and against the bias of spring means, characterized in that it comprises:

a housing formed on said slide and defining, rearwardly therein, a cylinder accommodating area;

a cylinder rotatably mounted in said area having a plurality of teeth disposed in an annular configuration on an end face of said cylinder;

pawl and ratchet means moveably mounted in said housing and being arranged to act on said teeth to rotate said cylinder;

a spring motor in said housing for actuating said pawl and ratchet means;

means for energizing said spring motor automatically by the recoil stroke of said slide on the frame each time a round is fired; and pusher means moveable guided in said frame and being linked mechanically to said firing mechanism for acting on said spring motor to energize it.

2. A revolver pistol according to claim 1 characterized inthat said cylinder is mounted removably and idly on an arm carried cantilever-fashion on a pin supported pivotally at a lateral location externally of said slide, said cylinder being moveable angularly about the axis of said pin from an operative position in said cylinder accommodating area to a position tilted sideways out of said cylinder accommodating area.

3. A revolver pistol according to claim 1 characterized in that it comprises a dummy hammer journalled rearwardly on said frame and being subjected to the action of a spring means, said dummy hammer having an active part held constantly pressed against said slide to resist its movement toward the rear of said frame.

4. A semiautomatic operation revolving cylinder pistol comprising a frame containing a firing mechanism and a slide supporting the barrel and cylinder of said pistol, said slide being guided moveably on said frame between two mechanical stops and against the bias of spring means, characterized in that it comprises:

a rear housing formed on said slide and defining, rearwardly therein, a cylinder accommodating area;

a cylinder mounted for rotation in said area and having a plurality of ratchet teeth on the end;

a cylindrical seat formed in said housing coaxially with said cylinder when fitted in said cylinder accommodating area, said cylindrical seat being open toward said one end of said cylinder;

a disk rotatably and slidingly positioned in said cylindrical seat and having a surface forming said cylinder;

at least one tooth formed on said surface of said disk confronting said cylinder, said at least one tooth being disposed in ratcheting engagement with said ratchet teeth formed on said cylinder;

a rack slider guided moveably in said housing in constant engagement with said disk and a spring for biasing said slider in one direction;

means for loading said spring automatically being actuated by the recoil stroke of said slide each time that a round is fired; and a pusher guided moveably on said frame, linked mechanically to the firing mechanism, and acting on said slider and said spring to load said spring.

5. A revolver pistol according to claim 4 characterized in that said slider is engaged slidingly in a through bore formed in said frame in a direction perpendicular to and intersecting the cylindrical seat housing said disk, said slider being provided, on the end thereof facing said frame, with a wheel held by said spring in rolling engagement with a track formed on top of said frame and having a section climbing up toward the rear thereof.

6. A revolver pistol according to claim 5 characterized in that said slider is formed axially with a blind hole wherein said spring is positioned, means for resisting the bias of said spring carried on said housing and extending across said blind hole through a slot of set length formed longitudinally in said slider.

7. A revolver pistol according to claim 5 characterized in that said pusher includes a slide mounted for a sliding movement on guides carried on said frame, being moveable to and from said track to engage with and urge said slider against the bias of said spring, said slide being connected mechanically to a lever of said firing mechanism actuated on cocking or pulling the trigger.

8. A revolver pistol according to claim 4 characterized in that it comprises a trigger mounted slidingly in guide means formed longitudinally on said frame.

9. A semiautomatic operation revolving cylinder pistol, comprising a frame containing a firing mechanism and a slide supporting the barrel and cylinder of said pistol, said slide being guided moveably on said frame between two mechanical stops and against the bias of spring means, characterized in that it comprises:

a rear housing formed on said slide and defining, rearwardly therein, an area for accommodating said cylinder;

a cylinder rotatably mounted in said area and having ratchet teeth on one end thereof;

a slider guided moveably in said housing inside a through bore formed therein in a perpendicular direction to said frame and said barrel, a spring biasing said slider in one direction;

a wheel mounted rotatably on the end of said slider confronting said frame, said wheel being held by said spring in rolling engagement with a track formed on top of said frame and having a section climbing up toward the rear thereof;

a pawl lever journalled on the other end of said slider and having a foot jutting out toward said cylinder to engage, ratchet-fashion, with said ratchet teeth formed on said cylinder, and a spring for biasing said pawl lever toward said cylinder.

* * * * *